United States Patent [19]

Nicoloso

[11] 4,386,250

[45] May 31, 1983

[54] DEVICE FOR SEPARABLY ASSEMBLING TWO ENCLOSURES OF A CUT-OUT APPARATUS CONTAINING FLUID UNDER PRESSURE

[75] Inventor: Dante Nicoloso, Meyzieu, France

[73] Assignee: Societe Anonyme dite: Alsthom-Atlantique, Paris, France

[21] Appl. No.: 211,999

[22] Filed: Dec. 1, 1980

[30] Foreign Application Priority Data

Nov. 30, 1979 [FR] France ..... 79 29498

[51] Int. Cl.[3] ..... H01H 33/72

[52] U.S. Cl. ..... 200/148 R; 200/148 B

[58] Field of Search ..... 200/148 R, 148 B, 148 F, 200/150 G

[56] References Cited

U.S. PATENT DOCUMENTS 3,278,712 10/1966 Tominaga ..... 200/148
4,041,263 8/1977 Noeske ..... 200/150 G
4,237,356 12/1980 Ragaller ..... 200/150 G
4,278,860 7/1981 Wu ..... 200/148 R

FOREIGN PATENT DOCUMENTS 2272475 of 0000 France .
609874 10/1960 Italy ..... 200/148 F
432330 of 0000 Switzerland .

*Primary Examiner*—A. T. Grimley
*Assistant Examiner*—Morris Ginsburg
*Attorney, Agent, or Firm*—Sughrue, Mion, Zinn, Macpeak and Seas

[57] ABSTRACT

A device for separably assembling first and second enclosures of an electric cut-out apparatus, said enclosures being filled with a dielectric fluid under pressure and having a rod for operating the cut-out apparatus passing therethrough with the compressed fluid in each of said enclosures being in communication with the compressed fluid in the other enclosure when the cut-out apparatus is in operation. The assembly device includes an intermediate slidable sealing air lock (41) which seals the first chamber and the second chamber. The air lock includes first and second separable portions (7,45) which are fast with respective ones of said enclosures. The operating rod (42) inside the air lock is separable into first and second portions (6,12) which are fast with respective ones of said enclosures. The invention applies in particular to compressed gas high tension circuit breakers.

6 Claims, 8 Drawing Figures

DEVICE FOR SEPARABLY ASSEMBLING TWO ENCLOSURES OF A CUT-OUT APPARATUS CONTAINING FLUID UNDER PRESSURE

FIELD OF THE INVENTION

The invention relates to high tension electric cut-out apparatus which, for technical reasons, must be kept filled with a dielectric gas or liquid either during transport of the apparatus in separate components from the place of manufacture to the installation site, or during dismantling of the components for maintenance operations. The invention applies, in particular, to apparatus which contains a gas of high dielectric strength, e.g. sulphur hexafluoride, and under pressure.

BACKGROUND OF THE INVENTION

For high voltages, such components are generally constituted firstly by the cut-off units disposed in one or several cut-out chambers placed in the upper portion of the apparatus and secondly by insulating supports through which there pass the operating rods of the cut-out units. In service, the cut-out chambers and the supports are assembled so that they are sealed from the outside while inter-communicating internally. However, for transport or maintenance, it is advantageous to be able to separate these various components while ensuring that each of these components remains sealed on its own.

Thus, French patent application No. 74 17 453 of May 20, 1974, (corresponding to U.S. Pat. No. 4,016,383 and Indian Pat. No. 144, 945), describes sealing devices which allow very high tension cut-out apparatus to be assembled or dismantled in a factory or on an operating site without requiring the components of the cut-out apparatus to be drained, pumped down to a vacuum and refilled. However, before any dismantling operation, these devices require a longer stroke to be provided for the moving equipment of the apparatus beyond the normal end of stroke position. In practice, this makes it necessary to remove the end of normal stroke stop before being able to separate the operating rods from the cut-out units.

Preferred embodiments of the invention provide a device enabling assembly of cut-out apparatus components containing fluid under pressure, and separation of the assembled components, without entailing modification of the end of normal stroke of the moving parts of the cut-out apparatus.

SUMMARY OF THE INVENTION

The invention provides a device for separably assembling first and second enclosures of an electric cut-out apparatus, said enclosures being filled with a dielectric fluid under pressure and having a rod for operating the cut-out apparatus passing therethrough, with the compressed fluid in each of said enclosures being in communication with the compressed fluid in the other enclosure when the cut-out apparatus is in operation, wherein said device for separably assembling the enclosures comprises: an intermediate slidable sealing air lock which includes first means for sealing the first chamber and second means for sealing the second chamber, said air lock including first and second separable portions which are fast with respective ones of said enclosures, said operating rod including, inside the air lock, means for separating it into first and second portions which are fast with respective ones of said enclosures.

According to one feature the air lock is constituted by a cylindrical space formed between the end of the first portion of the rod and the inside of a hollow piston, said air lock being delimited on one side by a boss on said first portion of the rod which co-operates with a first portion of said piston and on the other side by a flange of the second portion of the rod which co-operates with the second portion of said piston.

According to other features, the end of the first enclosure is provided with an assembly plate for assembly with a second plate on the end of the second enclosure, said first plate including a cylindrical sleeve with a slide block disposed against its inside, said slide block being fast with the second plate and being provided with sealing means.

The piston head is slidably disposed and provided with sealing means inside the cylindrical sleeve and the flange of the piston is slidably disposed and provided with sealing means inside the slide block.

The piston head is provided with means for making it fast with the piston body and with the plate, as well as means for making it fast with the first portion of the rod when the two portions of the piston are separated.

DESCRIPTION OF PREFERRED EMBODIMENTS

Figure 1:
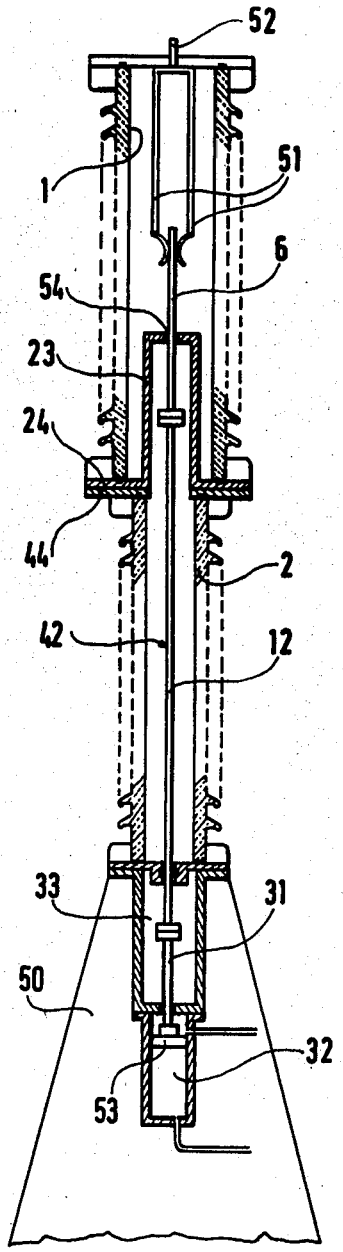
FIG. 1 illustrates a schematic general half cross-section of a compressed gas cut-out apparatus in the closed position.

FIG. 1 illustrates cut-out apparatus whose upper portion includes a cut-out chamber 1 formed by a cylindrical ceramic insulator assembled on a cylindrical insulating support 2 which rests on a metal frame 50. The cut-out chamber contains stationary contact fingers 51 connected to an external connection terminal 52. The stationary contact fingers co-operate conventionally with a moving contact formed at the end of a rod 6 lying on the axis of the cut-out chamber.

The rod 6 constitutes the upper portion of an operating rod of the moving contact, the whole of the operating rod being referenced 42 and including a second insulating portion 12 and a third portion 31. The insulating portion 12 passes through the cut-out chamber 1, the insulating support 2 and an intermediate chamber 33 interposed under the insulating support 2, between it and an operating jack 32. The rod portion 31 is connected firstly to the inside of the chamber 33 at the portion 12 of the insulating rod and secondly to the piston 53 of the jack 32 which controls the operation of the operating rod assembly 42 of the moving contact.

The rod 6 is conductive and is connected by a sliding contact 54 and a cylindrical sleeve 23 to a plate 24 which supports an external connection terminal, not shown.

The enclosures formed by the cut-out chamber 1, the insulating support 2 and the intermediate chamber through all of which the operating rod 42 passes are filled with a dielectric gas and sealed from the outside while they communicate normally with one another.

Figure 2:
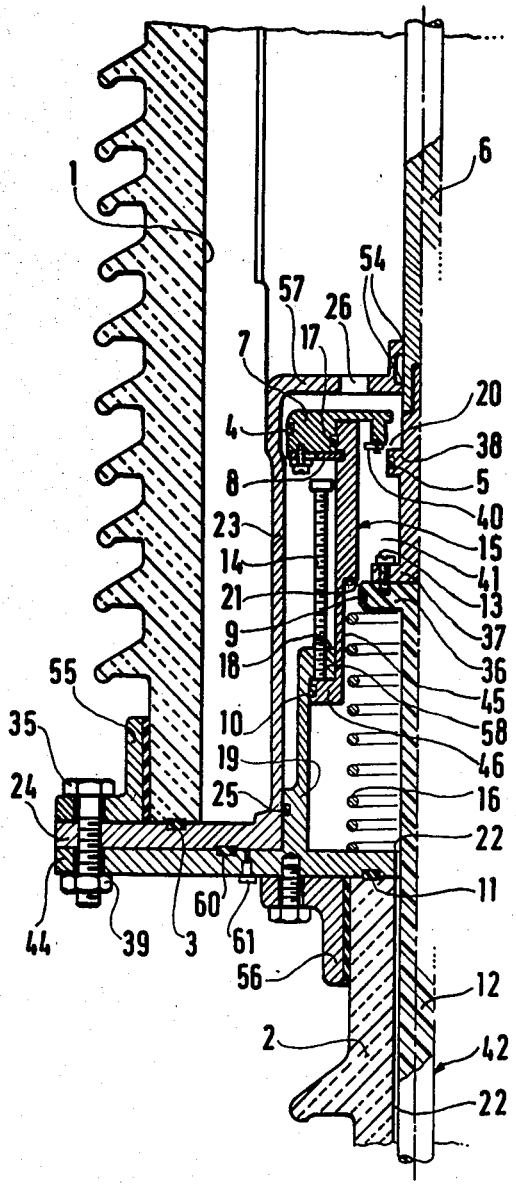
FIG. 2 illustrates a schematic half cross-section showing in detail the assembly device between two enclosures of the the cut-out apparatus of FIG. 1 in the closed position.

FIG. 2 shows in detail how the cut-out chamber 1 and the insulating support 2 are assembled together. At the lower end of the cut-out chamber 1, a fixing collar 55 is screwed onto the annular plate 24. At the upper end of the insulating support 2, another fixing collar 56 is screwed onto an annular plate 44. The assembly formed by the collar 55 and the plate 24 is assembled to the plate 44 by means of nuts 39 and bolts 35. Sealing is provided between the cut-out chamber 1 and the plate 24 by a seal 3 and between the insulating support 2 and the plate 44 by a seal 11.

The annular plate 24 has a cylindrical sleeve 23 on its inner periphery. Said sleeve extends inside the cut-out chamber 1 and has an annular top 57 which surrounds the rod 6 and bears the sliding contact 54. The top 57 also has orifices 26.

The inner periphery of the annular plate 44 is disposed facing a passage 22 which surrounds the insulating rod 12. The plate 44 also includes a slide block 19 whose base adjoining said plate is provided with a seal ring 25 which co-operates with the inner wall of the cylindrical sleeve 23 in which it is inserted. The end of the slide block 19 is provided with an inwardly directed flange 18 with tapped holes 58 passing right through it in a direction parallel to the rod 42.

A hollow piston assembly referenced 15 is disposed round the rod portions 6 and 12 and between the cylindrical sleeve 23 and the slide block 19.

The piston 15 includes firstly a cylindrical body 45 with an outwardly directed flange 46 disposed under the flange 18 and is provided with a seal ring 10 which co-operates with the inside of the slide block 19, and secondly a cylindrical annular head 7 with sides which extend beyond the walls of the cylindrical body 45. The outer wall of the head 7 is fitted with a seal 4 which is designed to co-operate with the inner wall of the cylindrical sleeve 23 and a seal ring 17 is interposed between the cylindrical body 45 and the head 7. Retractable lugs 8 are disposed under the outer side of the head 7, while other retractable lugs 40 are disposed under the inner side of the head 7. A compression spring 16 is interposed between the body 45 and the plate 44 under a backed off portion of said body, while adjusting screws 14 whose heads are disposed facing the lugs 8 engage in tapped holes 58.

The upper end of the insulating rod 12 includes a circular flange 36 whose peripheral surface is provided with a seal ring 9 designed to co-operate with the inner wall of the cylindrical body 45.

A co-operating flange 37 on the lower end of the rod 6 is fixed on the flange 36 by means of screws 13. The rod 6 further includes a circular boss 38 whose periphery is provided with a seal ring 5 designed to co-operate with the inner wall of the piston head 7.

In FIG. 2 which illustrates the cut-out apparatus in the closed position, the operating rod 42 is shown driven by the operating jack 32 into the high position in which a variable volume is formed firstly between the rod 6 and the cylindrical body 45 of the piston and secondly between the flange 36 and the inner side of the piston head 7, said variable volume forming an air lock 41 which, on one side, has an annular passage 21 between the end of the flange 36 and the cylindrical body 45 and, on the other side, has an annular passage 20 between the boss 38 and the inner side of the piston head 7.

The enclosures constituted by the cut-out chamber 1 and the insulating support 2 are sealed and filled with dielectric gas under pressure. However, these two components communicate freely with each other via the orifices 26, the passage 20, the air lock 41, the passage 21 and the passage 22 between the insulating rod 12, the plate 44 and the insulating support 2.

When the cut-out apparatus is in the open position, with the operating rod 42 lowered by the operating jack 32, the annular passages 20 and 21 open the air lock 41 wider and the enclosures still communicate with each other.

Figure 3:
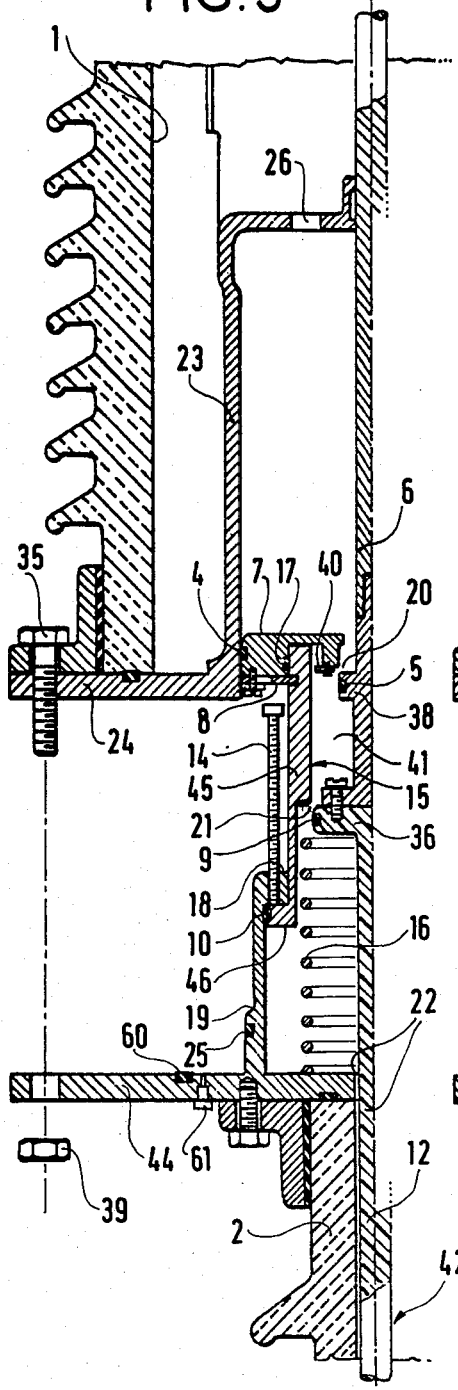
FIG. 3 illustrates the assembly device as in FIG. 2 in a first dismantling step.
Figure 4:
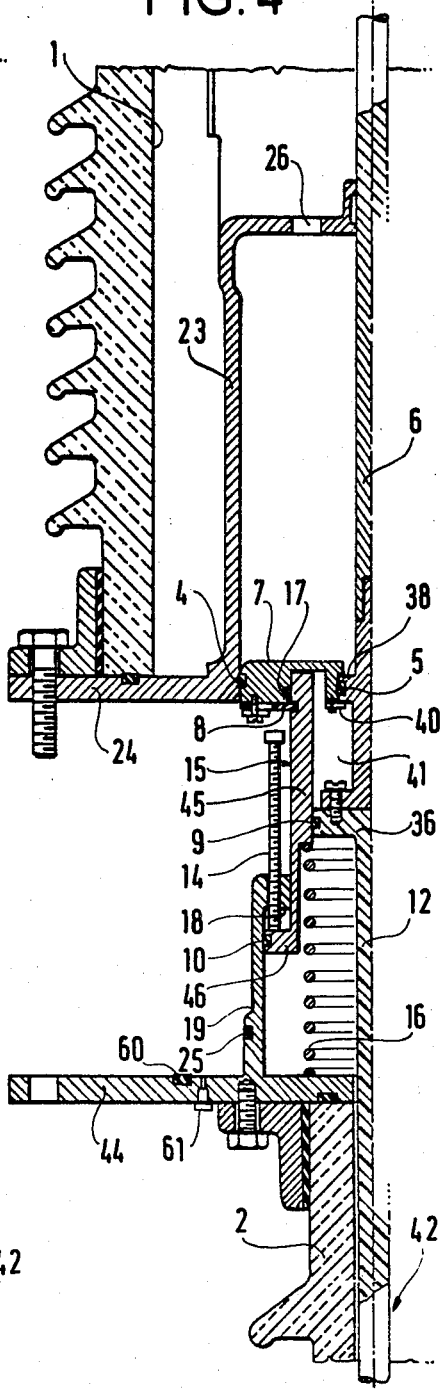
FIG. 4 illustrates the assembly device as in FIG. 3 in a second dismantling step.

With the apparatus in the closed position, the cut-out chamber is dismantled and separated from the insulating support 2 as follows. During a first phase which ends with the device in the position illustrated in FIG. 3, firstly, these two components are separated from each other by removing the nuts 39 from the connecting bolts 35, then, by hoisting means, not shown, the plate 24 and the cut-out chamber 1 are lifted off the plate 44. During this operation, the cylindrical sleeve 23 slides firstly along the slide block 19 then on the piston head 7. The cut-out chamber 1 is sealed firstly by the seal 25 then simultaneously by seals 25 and 4 before the seal is separated from the sleeve 23. After this operation, the access to the heads of the screws 14 is clear and it is possible to drive the screws 14 home. The piston flange 46 which abutted against the flange 18 is driven home, the outer side of the head continues to slide against the wall 23, but the inner slide of the head 7 engages along the passage 20 until it abuts against the boss 38 while the flange 36 engages along the cylindrical body 45 as shown in FIG. 4.

In this position it appears that the air lock 41 has slid in such a way that the annular passages 20 and 21 have disappeared and that the air lock no longer communicates with the enclosures of the cut-out chamber 1 and the insulating support 2. The seals 9 and 5 then provide sealing. In this position the piston head 7 is made fast with the rod 6 by placing the lug 40 under the boss 38, then the head 7 is detached from the cylindrical body 45 by retracting the lug 8 and the head 7 is made fast with the plate 24 by returning the lug 8 to its former position illustrated in FIG. 5.

Figure 5:
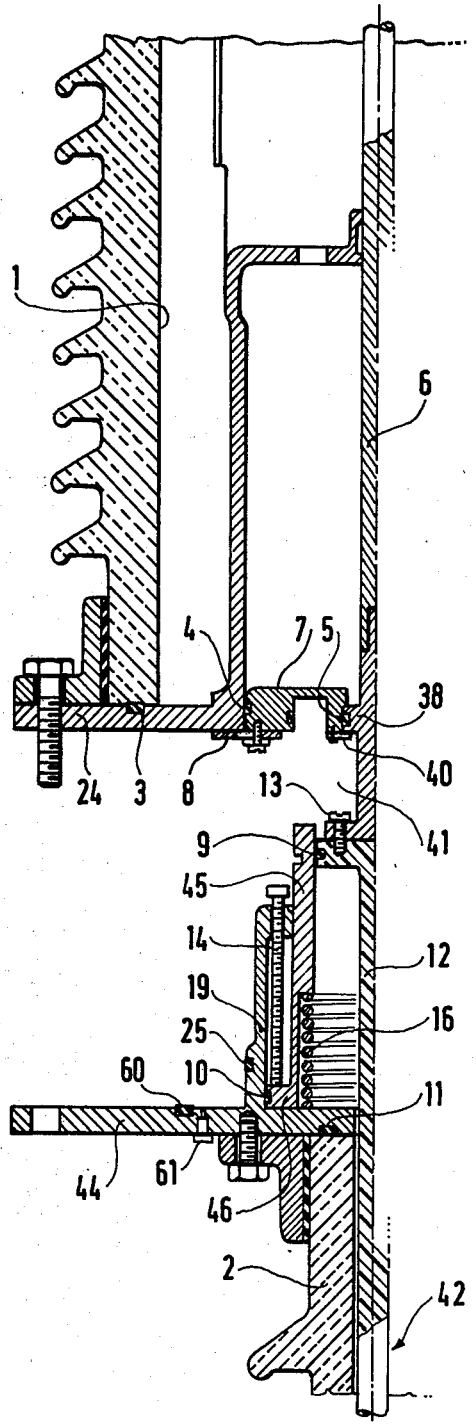
FIG. 5 illustrates the assembly device as in FIG. 4 in a third dismantling step.

When the position illustrated in FIG. 5 is reached, the screw 14 is further screwed in until the flange 46 abuts against the plate 44 thereby compressing the spring 16.

The air lock 41 is thereby opened. This allows access to the screws 13 connecting the insulating rod 12 to the rod 6. After removing the screws 13, the cut-out chamber 1 can be completely separated from the insulator 2 while the enclosures remain sealed.

Gas is lost in the dismantling operation only via the air lock 41 and the volume between the cylindrical sleeve 23 and via the piston 15 and the slide block 19.

The chamber 1 is assembled on the insulating support 2 in the reverse order to dismantling. The volume of air comprised between the seal 25 and the seal 60 which are interposed between the plates 24 and 44 is removed via a bleed valve 61.

The same assembly device can be applied to the connection between the insulating support 2 and the intermediate chamber 33.

When the device is dismantled in a damp atmosphere, traces of moisture may be absorbed by walls constituted by the outer surface of the slide block 19 and of the cylindrical sleeve 23.

Such moisture contained within the electrical device after assembly can be detrimental to good electrical insulation.

Several variants are provided to mitigate this drawback.

Figure 6:
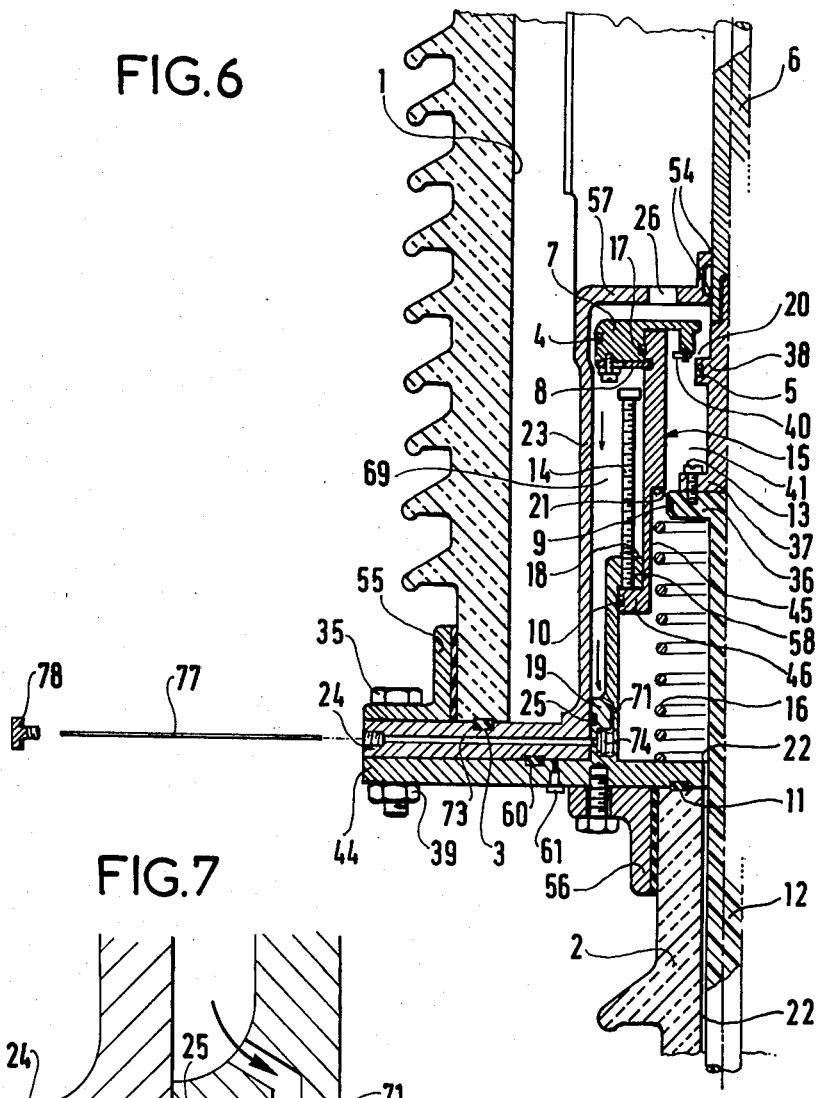
FIG. 6 illustrates a partial half cross-section of a first variant of the assembly device.
Figure 7:
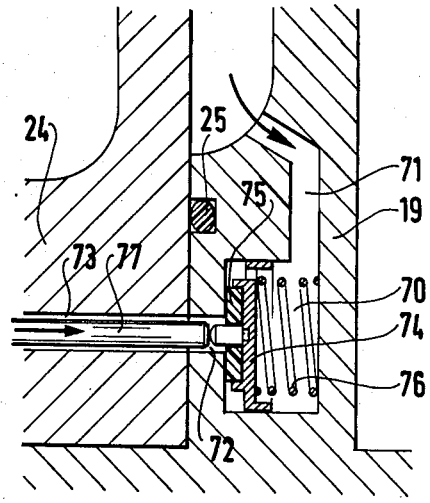
FIG. 7 illustrates an enlarged detail in FIG. 6.

In the embodiment illustrated by FIGS. 6 and 7, a cavity 70 is provided in the lower portion of the slide block 19. Said cavity communicates via a passage 71 with the inside of the volume 69 delimited by the slide block 19 and the sleeve 23. The cavity 70 communicates with a duct 73 via a second passage 72 formed in the plate 24 and communicating with the exterior thereof.

The cavity can be closed by a valve 74 provided with a seal 75 pressed by a spring 76.

Operation is as follows: after the device has been assembled and to remove all traces of moisture from inside it, the valve 74 is opened by pushing it from the outside by means of a rod 77. The compressed gas contained inside the device escapes towards the outside, sweeping through the volume 69 and driving out the air and any traces of moisture absorbed by the walls of this volume.

The compressed gas continues to sweep through the volume 69 until the pressure inside the device drops. e.g. from 0.3 to about 0.1 bars. The rod 77 is then removed and a stopper 78 is inserted in its place.

Figure 8:
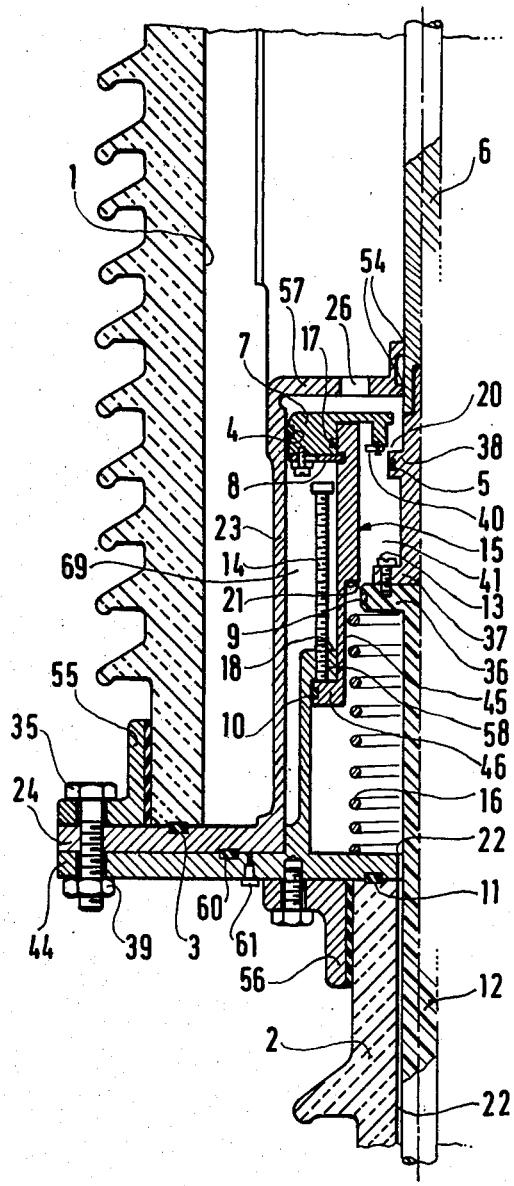
FIG. 8 illustrates a partial half cross-section of a second variant of the assembly device.

In the variant illustrated in FIG. 8, the volume 69 never communicates with the inside of the device.

For this purpose, the inside diameter of the sleeve 23 is constant so as to provide permanent contact between the annular piston head 7 and the sleeve 23 by interposing the seal ring 4.

Therefore, the air contained in the volume 69 as well as any moisture therein which appears during dismantling cannot enter the device after assembly.

The seal 25 provided in the embodiments of the assembly device illustrated by FIGS. 1 to 7 can here be omitted. This simplifies the slide block 19.

The assembly device is also applicable to circuit breakers contained in metal casings which are filled with compressed gas, detachable coupling without bleeding the gas being effected at the point where the jacks are coupled or at the connection between two components.

I claim:

1. In an electric cut-out apparatus, the combination comprising: a device for separately assembling and disassembling first and second end-to-end joined cylindrical enclosures of said electric cut-out apparatus while maintaining fluid seal integrity for respective enclosures, said enclosures being filled with a dielectric fluid under pressure, an operating rod passing axially through said enclosures for operating said cut-out apparatus with the compressed fluid in each of said enclosures being in communication with each other when the cut-out apparatus is in operation, the improvement wherein said device comprises:

a slidable sealing air lock intermediate of said end-to-end joined enclosures including first means for sealing said first enclosure and second means for sealing said second enclosure, first and second separable portions which are fast with respective ones of said enclosures, and said operating rod including, inside the air lock, means for separating said rod into first and second portions which are fast with respective ones of said enclosures, and wherein said air lock includes a hollow piston surrounding the end of the first separable portion of said rod and defining a cylindrical space between said rod portion and the inside of said hollow piston, a boss on said first separable portion of said rod and sealably engaging a first portion of said piston to delimit one side of said air lock and a flange on said second separable portion of said rod sealably engaging a second portion of said piston and delimiting the other side of said air lock.

2. The combination according to claim 1, wherein the end of the first enclosure joining the end of the second enclosure is provided with a first assembly plate, a second plate carried by the end of the second enclosure for assembly to said first plate, said first plate including a cylindrical sleeve, and a slide block fast with the second plate and sealably disposed within said cylindrical sleeve.

3. The combination according to claim 2, wherein a piston head is slidably and sealably disposed inside the cylindrical sleeve, and wherein a flange of the hollow piston is slidably and sealably disposed inside the slide block.

4. The combination according to claim 3, wherein a cavity is provided at a base of the slide block and communicates firstly via a first passage with the volume delimited by the sleeve and the slide block and secondly via a second passage and via a duct in the plate with the outside, said cavity being closed by a valve which is accessible via the duct.

5. The combination according to claim 1, wherein the end of the first enclosure includes a first plate, a second plate on the facing end of the second enclosure, said first plate including a cylindrical sleeve, a slide block fast with said second plate and disposed inside said cylindrical sleeve, a piston head slidably and sealably disposed inside said sleeve, a flange of said hollow piston being slidably and sealably disposed inside the slide block, the inside diameter of the sleeve being constant along its entire length to prevent any communication between the volume comprised between the sleeve and the slide block and the insides of the enclosures.

6. The combination according to claim 3, wherein the piston head is provided with means for making it fast with the hollow piston and with said first plate, as well as means for making it fast with the first separable portion of the rod when the two portions of the rod are separated.

* * * * *